US006580803B1

(12) United States Patent
Peng

(10) Patent No.: US 6,580,803 B1
(45) Date of Patent: Jun. 17, 2003

(54) STRUCTURE FOR CHANGING SOUND QUALITY OF SPEAKER

(75) Inventor: Jack Peng, Chung Li (TW)

(73) Assignee: Meiloon Industrial Co., Ltd., Taipei (TW)

( * ) Notice: Subject to any disclaimer, the term of this patent is extended or adjusted under 35 U.S.C. 154(b) by 230 days.

(21) Appl. No.: 09/679,536

(22) Filed: Oct. 6, 2000

(51) Int. Cl.[7] ..... H04R 25/00
(52) U.S. Cl. ..... 381/412
(58) Field of Search ..... 381/397, 419, 381/412, 337, 338, 339, 340, 343, 345, 396

(56) References Cited

U.S. PATENT DOCUMENTS 5,701,357 A * 12/1997 Matsuo et al.

5,878,149 A * 3/1999 Hamada et al.

* cited by examiner

*Primary Examiner*—Sinh Tran
(74) *Attorney, Agent, or Firm*—Troxell Law Office PLLC

(57) ABSTRACT

A structure for changing the sound quality of a speaker having an iron cone is disclosed. The iron cone has a center post with a via hole for assembling a plurality of tube bodies each having a different thickness. The via hole of iron cone and the plurality of tube bodies have tapered shapes with a wider upper end and a narrow lower end. An inner wall of the tube body is installed with respective embedding holes so that in updating, the tube body can be pulled out conveniently. Thereby, different tube body being inserted into the via hole for changing the QT value of the speaker; wherein a user can update the tube body as desired to change the sound quality.

3 Claims, 6 Drawing Sheets

STRUCTURE FOR CHANGING SOUND QUALITY OF SPEAKER

FIELD OF THE INVENTION

The present invention relates to an improvement of the sound quality of a speaker, and especially to a structure for changing sound quality of a speaker in which tube bodies with different thickness can be updated so that different QT (quality factor) value is formed in the speaker.

BACKGROUND OF THE INVENTION

In general, a speaker is formed by a casing, a magnet, a coil, a damper, a vibration piece, a dust-proof cover, an iron core, a washer, a yoke, etc. One end of the coil is connected to the vibration piece, while another end is placed with the iron core to be around the outer periphery of a center post. As conduction, the coil is absorbed to cut the vibration so that the vibration piece amplifies the vibration to be transfer in the air so as to be formed with sound wave sensible by ears.

In manufacturing, a via hole is installed in the center post of the iron core so as to cut the air path by changing the inner diameter of an opening as the speaker is operated, and therefore, different sound qualities are formed.

The prior art speaker has via holes with fixing size, therefore, there are following defects in use:

1. Since the diameter of the via hole is fixed, in manufacturing, for the requirement of different QT values, different hardware structures are necessary for conforming the requirement of different QT values. For example, as a consumer requests a speaker with three different QT values, the manufacturer must design three structures of the speaker with the requirement of the QT value. Consequently, the procedure in manufacturing is trouble. Moreover, too many categories will make a great deal of inventory so that a large space is required for storing the inventory and the cost is therefore increased.

2. The center post of iron core has a fixed diameter for the via hole, therefore, emitted sound quality is fixed. After installation, only adjusting a tone button in the stereo is possible for adjusting the sound quality. It is impossible by only simply changing the structure of the speaker for outputting different QT value.

3. In general, some low level devices, such as a car stereo, have no tone button for adjusting the sound quality of a stereo with favorites of users. However, this can not satisfy the requirement of the modern listeners.

SUMMARY OF THE INVENTION

Accordingly, the present invention provides a structure for changing the sound quality of a speaker, in which tube bodies with different thickness can be updated, and thus, sound quality of the speaker can be adjusted according to the user's requirement.

Another object of the present invention is to provide a structure for changing the sound quality of a speaker, wherein detachable tube bodies and a pull are provided.

To achieve aforesaid object, the present invention provides a structure for changing the sound quality of a speaker having a iron core. The iron core has a center post with a via hole for assembling a plurality of tube bodies each having a different thickness. Thereby, different tube body is inserted into the via hole for changing the QT value of the speaker; wherein a user can update the tube body as desired to change the sound quality.

In the present invention the via hole of iron core and the shapes of the plurality of tube bodies have slight conoid shapes with a wider upper end and a narrow lower end. An inner wall of the tube body is installed with respective embedding holes so that in updating, the tube body can be pulled out conveniently.

The various objects and advantages of the present invention will be more readily understood from the following detailed description when read inm conjunction with the appended drawings.

DETAILED DESCRIPTION OF THE PREFERRED EMBODIMENTS

Figure 1:
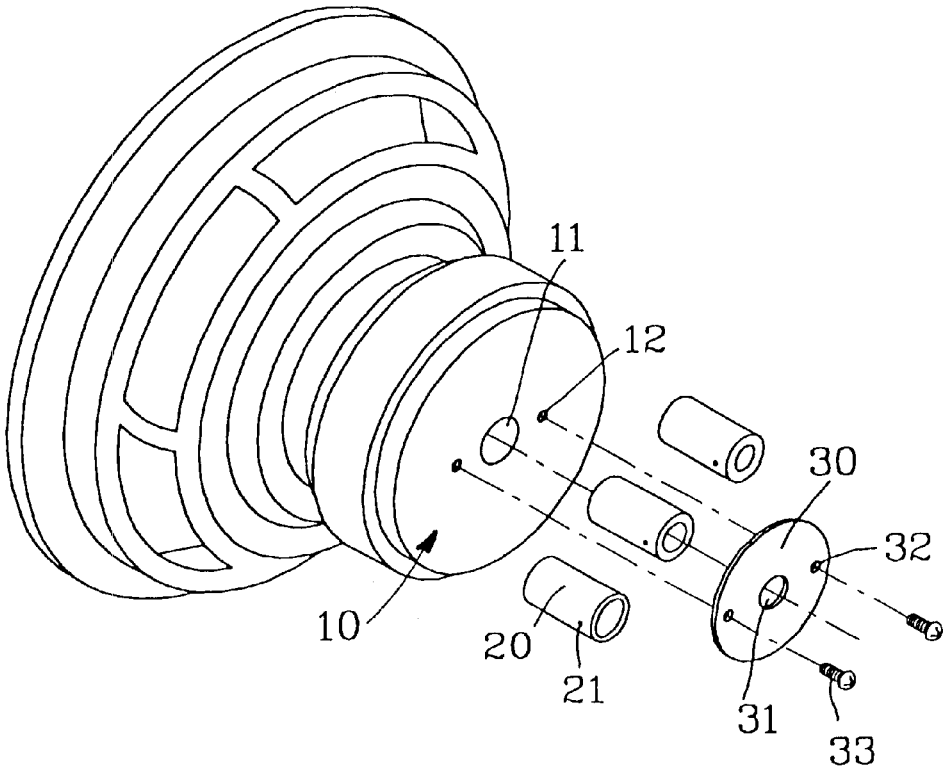
FIG. 1 is an exploded perspective view of the present invention.
Figure 2:
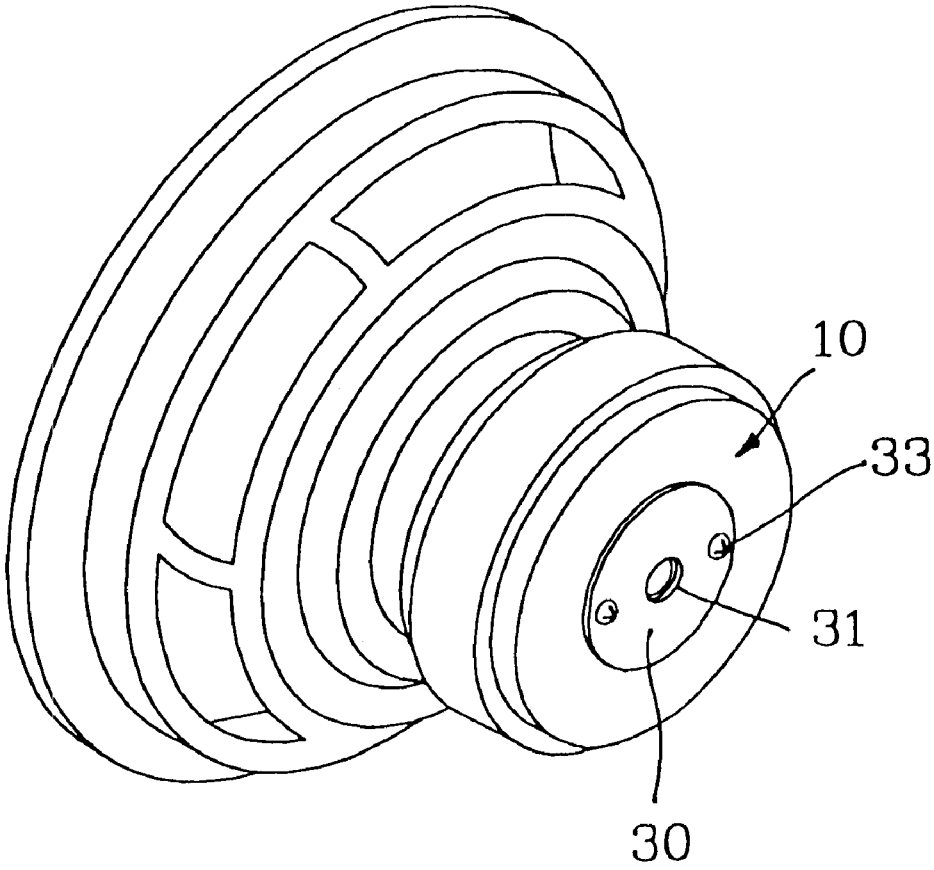
FIG. 2 is an assembled perspective view of the present invention.
Figure 3:
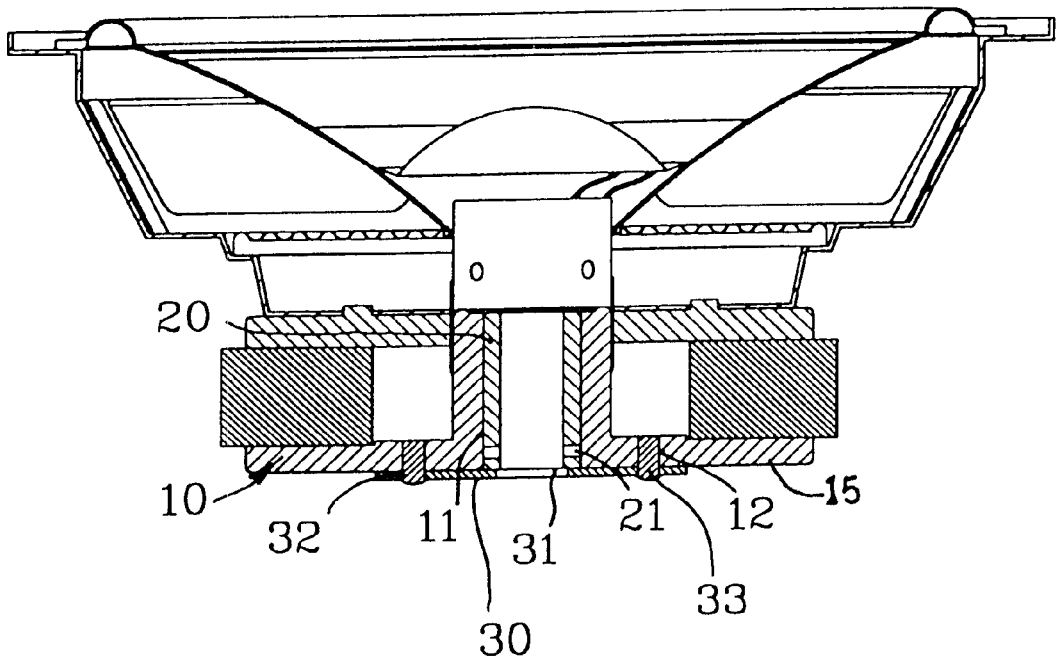
FIG. 3 is a plane perspective view of the present invention.

With reference to FIGS. 1–3, the structure for changing the sound quality of a speaker of the present invention primarily includes an iron core 10, a plurality of tube bodies 20, a retainer 30 and a pull 40.

The appearance of the iron core 10 is similar to that of the prior art iron core. A via hole 11 is installed in the center post 16. The via hole 11 is a tapered hole with a wide top and a narrow bottom. The base 15 of the iron core 10 is installed with retaining holes 12 around the center protrusion.

Figure 6:
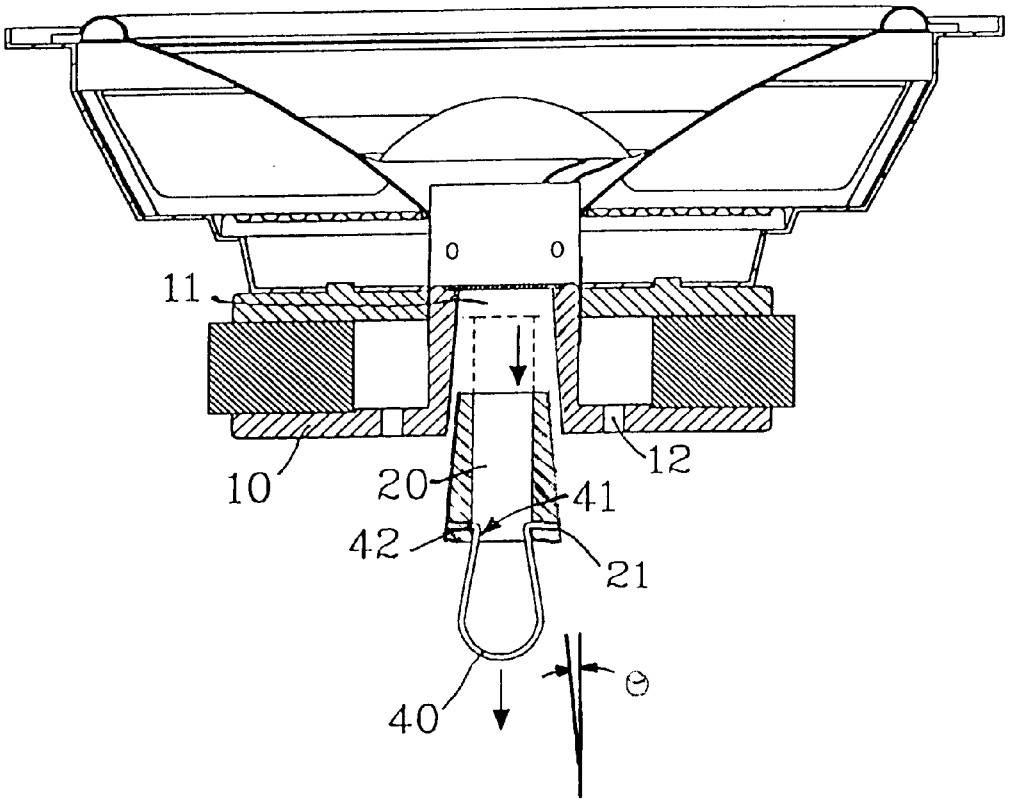
FIG. 6 is a schematic view showing the operation of updating a tube body having a conoid shape of the present invention.

A plurality of tube bodies 20 each have a shaped matching to that of the via hole 11 in the center protrusion and having a slight conoid shape that is defined by an angle θ as shown in FIG. 6. Each tube body 20 has a thickness according to different QT value so as to be formed with diameter of different size. The end portion with a large diameter is formed with an embedded hole 21.

The retainer 30 has a proper size and a through hole 31 is formed at a center thereof. The diameter of the through hole 31 is larger than that of the center post 11 in the center of the iron core 10, and retaining holes 32 are installed at positions matching to those of the retaining holes 12 at the bottom plane of the iron core 10. Screws 33 are provided to the retaining holes 32 for fixing.

The pull 40 is installed with an elastic clamping opening 41. The end portion of the clamping opening 41 is formed with tenons 42 extended horizontally.

Thereby, a shown in FIG. 3, as the present invention is applied, the tube body 20 can be placed into the via hole 11 in the center post 16 of the bottom of the iron core 10 and then the retainer 30 is placed near the bottom of the base 15 of the iron core 10 so that the retaining holes 12 and 32 are aligned. Then, screws 33 serve to lock the two components. The through hole 31 of the retainer 30, through hole of the tube body 20 and the through hole 11 of the iron core 10 are aligned to be formed as a via hole and thus sound can be outputted successfully. The tube bodies 20 tightly resists in the via hole 11 for being confined therein so that as sound is output, no noise is generated for collision.

Figure 4:
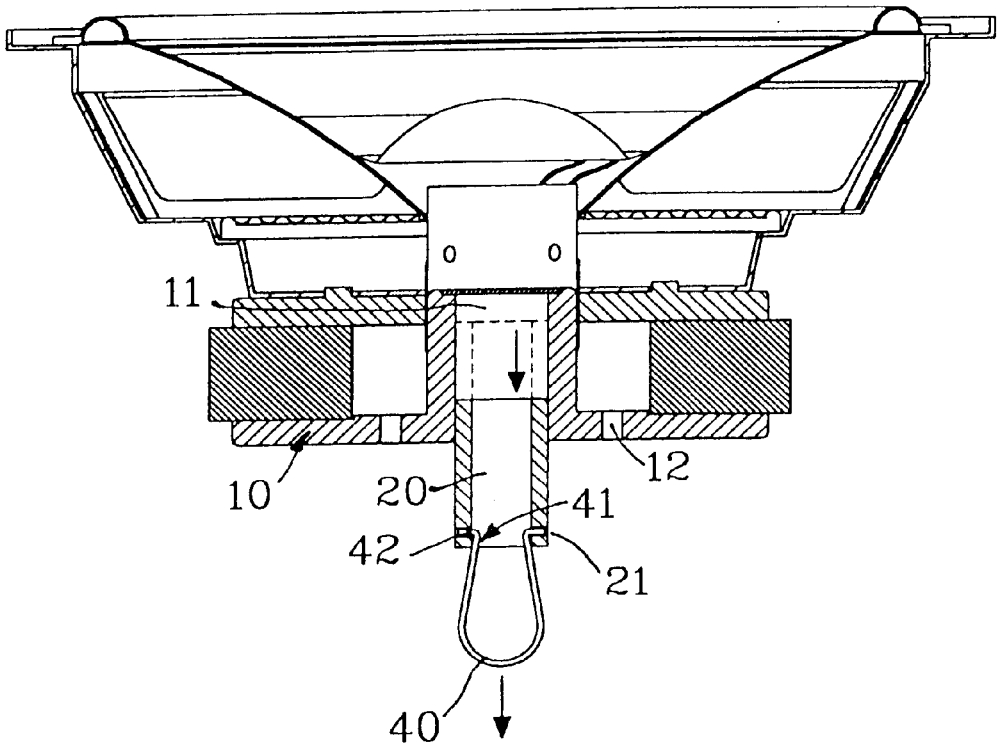
FIG. 4 is a schematic view showing the operation of updating a tube body in the present invention.
Figure 5:
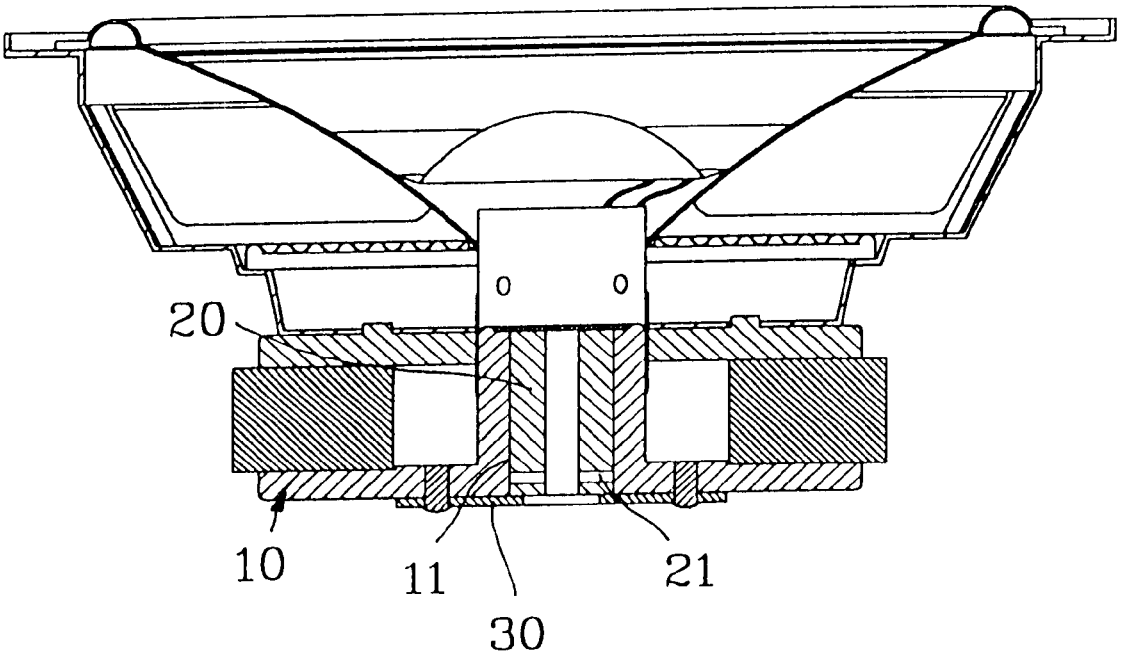
FIG. 5 is a schematic view showing that the present invention can be placed with tube body of different thickness.

Referring to FIGS. 3 to 5, as different sound quality is necessary to be outputted, the screw 33 can be released and then the retainer 30 is taken down. The clamping opening 41 in the pull 40 is pressed and is inserted into the tube body 20 in the center post of the iron core 10. Then the tenons 42 at two sides of the clamping opening 41 are placed into the embedding holes 21 of the tube bodies 20 and then the pull is pulled out. Then another tube body 20 with a proper thickness can be updated so that the speaker can emit sound of different sound quality.

As noted above, since the QT value of a speaker structure can be changed rapidly due to the different inside diameters of the tube body, as the customer requires two or more different QT values, only one casing with a via hole 11 is needed to be manufactured, and then different tube bodies each having a required QT value are appended for updating. Therefore, the manufacturing process is convenient and the inventory is reduced. Therefore, it has a great benefit in production.

Since the change in the speaker according to the present invention, as in selling with the stereo, a plurality of tube bodies 20 can be extra appended. As a result, the user only needs to adjust the button of the stereo, the sound quality thereof will change with the favorite of the user. It is only needed to update the tube body 20 without adjusting the button frequently.

In summary, according to above description, in the present invention, the diameter of the iron core can be adjusted and the speaker has a structure for adjusting the sound quality.

The present invention are thus described, it will be obvious that the same may be varied in many ways. Such variations are not to be regarded as a departure from the spirit and scope of the present invention, and all such modification as would be obvious to one skilled in the art to intended to be included within the scope of the following claims.

What is claimed is:

1. A structure for changing sound quality of a speaker, comprising:

a) an iron core, said iron core having a base and a center post with a via hole located on the iron core, the via through hole passing through a rear of the iron core;

b) a hollow tube body having a predetermined wall thickness removably mounted in the via through hole so as to be removable from the rear of the iron core; and, c) a retainer having a through hole and removably attached to the rear of the iron core so as to hold the hollow tube body in the via through hole, whereby different hollow tube bodies are inserted into the via through hole to change the sound quality of the speaker.

2. The structure for changing sound quality of a speaker as claimed in claim 1, wherein the base of the iron core has a plurality of screw holes to mount the retainer thereon and wherein an inner wall of the tube body has embedding holes, enabling the tube body to be pulled out conveniently.

3. The structure for changing sound quality of a speaker as claimed in claim 1, wherein the via through hole of iron core and the tube body have conoid shapes.

* * * * *